US009831584B2

(12) United States Patent
Singhammer et al.

(10) Patent No.: US 9,831,584 B2
(45) Date of Patent: Nov. 28, 2017

(54) PLUG-IN CONNECTOR

(71) Applicant: ROSENBERGER HOCHFREQUENZTECHNIK GMBH & CO. KG, Fridolfing (DE)

(72) Inventors: Martin Singhammer, Fridolfing (DE); Christian Biermann, Fridolfing (DE); Thomas Höfling, Grabenstätt (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/902,511

(22) PCT Filed: Jul. 2, 2014

(86) PCT No.: PCT/EP2014/001819

§ 371 (c)(1),
(2) Date: Dec. 31, 2015

(87) PCT Pub. No.: WO2015/000590

PCT Pub. Date: Jan. 8, 2015

(65) Prior Publication Data

US 2016/0380374 A1 Dec. 29, 2016

(30) Foreign Application Priority Data

Jul. 5, 2013 (DE) ..... 20 2013 006 067 U

(51) Int. Cl.

| | |
|---|---|
| ***H01R 12/91*** | (2011.01) |
| ***H01R 4/48*** | (2006.01) |
| ***H01R 13/11*** | (2006.01) |
| ***H01R 24/40*** | (2011.01) |
| *H01R 103/00* | (2006.01) |

(52) U.S. Cl.

CPC ..... *H01R 12/91* (2013.01); *H01R 4/48* (2013.01); *H01R 13/112* (2013.01); *H01R 24/40* (2013.01); *H01R 2103/00* (2013.01)

(58) Field of Classification Search

CPC ..... H01R 24/24; H01R 24/38; H01R 24/40; H01R 13/112; H01R 13/15; H01R 12/91; H01R 4/48

USPC ..... 439/8, 582, 248, 252, 246, 441

See application file for complete search history.

(56) References Cited

U.S. PATENT DOCUMENTS 4,941,836 A * 7/1990 Bormuth ..... H01R 13/6315 439/246
5,641,294 A * 6/1997 Beard ..... H01R 13/746 439/247
5,980,290 A * 11/1999 Meynier ..... H01R 13/6315 439/246

(Continued)

FOREIGN PATENT DOCUMENTS

DE 9106995 U1 8/1991
DE 102007059254 B3 4/2009

(Continued)

*Primary Examiner* — Amy Cohen Johnson
*Assistant Examiner* — Milagros Jeancharles
(74) *Attorney, Agent, or Firm* — DeLio, Peterson & Curcio LLC; Robert Curcio

(57) ABSTRACT

A plug-in connector having an inner conductor and an insulator which is surrounded by the inner conductor, the insulator having a first insulator part and a second insulator part which are interconnected such that they can rotate with respect to each other through an insulator joint.

17 Claims, 4 Drawing Sheets

(56) References Cited

U.S. PATENT DOCUMENTS

| | | | | |
|---|---|---|---|---|
| 6,287,144 | B1 * | 9/2001 | Baffert | H01R 4/28 439/578 |
| 6,361,348 | B1 | 3/2002 | Hall et al. | |
| 7,270,569 | B2 * | 9/2007 | Petersen | H01R 9/0521 439/582 |
| 7,717,716 | B2 * | 5/2010 | Dahms | H01R 12/52 439/248 |
| 7,766,659 | B2 * | 8/2010 | Otsu | H01R 24/547 439/11 |
| 8,033,851 | B2 * | 10/2011 | Tanaka | H01R 12/724 439/248 |
| 8,182,285 | B2 * | 5/2012 | Annequin | H01R 24/54 439/582 |
| 8,628,353 | B2 * | 1/2014 | Yokoyama | H01R 9/0518 439/409 |
| 8,801,459 | B2 * | 8/2014 | Mrowka | H01R 24/50 439/246 |
| 9,099,797 | B1 * | 8/2015 | Duesterhoeft | H01R 4/58 |
| 9,105,997 | B2 * | 8/2015 | Ohkuma | H01R 12/91 |
| 9,160,121 | B2 * | 10/2015 | Wagner | H01R 13/6315 |
| 2003/0143893 | A1 * | 7/2003 | Hall | H01R 9/05 439/582 |
| 2003/0171019 | A1 * | 9/2003 | Itoh | H01R 13/6315 439/247 |
| 2009/0017678 | A1 * | 1/2009 | Meier | H01R 9/0518 439/582 |
| 2010/0317226 | A1 * | 12/2010 | Schmid | H01R 24/54 439/582 |
| 2013/0330944 | A1 * | 12/2013 | Rucki | H01R 12/714 439/81 |
| 2015/0249309 | A1 * | 9/2015 | Dandl | H01R 13/112 439/682 |
| 2015/0303606 | A1 * | 10/2015 | Singhammer | H01R 13/502 439/136 |
| 2015/0349472 | A1 * | 12/2015 | Zebhauser | H01R 13/6463 439/660 |
| 2016/0218460 | A1 * | 7/2016 | Zebhauser | H01R 13/506 |

FOREIGN PATENT DOCUMENTS

| | | | |
|---|---|---|---|
| DE | 202012008969 | U1 | 11/2012 |
| EP | 0340952 | A1 | 11/1989 |
| EP | 2053705 | A2 | 4/2009 |
| EP | 2302742 | A1 | 3/2011 |
| EP | 2610971 | A1 | 7/2013 |
| WO | 2007098617 | A1 | 9/2007 |
| WO | 2011088902 | | 7/2011 |
| WO | 20120119826 | A1 | 9/2012 |

* cited by examiner

PLUG-IN CONNECTOR

BACKGROUND OF THE INVENTION

1. Field of the Invention

The invention relates to a plug-in connector. The invention also relates to a multiple plug-in connector which, in interaction with a mating plug-in connector, is in particular intended for the transmission of radio frequency signals between two circuit boards.

2. Description of Related Art

Plug-in connectors or multiple plug-in connectors should ensure the most loss-free possible transmission of radio frequency signals, including within a defined tolerance range in terms of parallelism as well as ensuring the distance between the two circuit boards. The plug-in connectors should also be economical to manufacture and should generally be sufficiently robust for integration in an assembly line.

It is known for a single connection (i.e., one forming a single radio frequency signal path) between two circuit boards to be established by means of two coaxial plug-in connectors firmly connected with the circuit boards as well as an adapter connecting the two coaxial plug-in connectors, the so-called "bullet". This adapter makes possible an equalization of axial and radial tolerances, as well as the equalization of tolerances of parallelism. Typical coaxial plug-in connectors used for this purpose are SMP, Mini-SMP, or FMC. If a plurality of radio frequency paths between two circuit boards is provided, a plurality of such single plugged connections must be used, which represents, in particular, a significant amount of complexity in assembly.

The complexity of assembly involved in connecting two circuit boards can be reduced significantly in comparison with the use of single plug-in connectors by means of multiple plug-in connectors which integrate a plurality of contact elements in a defined arrangement within a housing. However, the integration of a tolerance equalizing functionality in the multiple plug-in connector represents a challenge.

A plugged connection with two multiple plug-in connectors for the electrical connection of two circuit boards is known from DE 20 2012 008 969 U1. The multiple plug-in connectors are thereby designed as right-angled plug-in connectors, so that the plugging direction in which the two multiple plug-in connectors are plugged together is aligned parallel to the circuit boards. All of the contact elements are designed as stamped and bent sheet metal components. The individual inner conductors of one plug-in connector are thereby designed as flat contact lugs which are contacted on both sides by spring contact tabs of the corresponding inner conductors of the other plug-in connector, which are in a tong-like arrangement. In both plug-in connectors, the outer conductors surrounding the respective inner conductors are cage-formed in design, whereby the outer conductors of one of the plug-in connectors are pushed into the outer conductors of the other plug-in connector, resulting in a large surface-area contact on three sides of each outer conductor. In the multiple plug-in connectors known from DE 20 2012 008 969 U1 a tolerance-equalizing functionality is achieved through an elastic deformability and relative displaceability of the flat-surface contact elements.

SUMMARY OF THE INVENTION

Starting out from this prior art, the invention was based on the problem of providing a plug-in connector which, despite possessing a tolerance-equalizing functionality, is distinguished by a robust design.

This problem is solved through a plug-in connector according the independent claims. A multiple plug-in connector integrating several plug-in connectors according to the invention is the subject matter of an independent claim. Advantageous embodiments of the plug-in connector according to the invention and of the multiple plug-in connector according to the invention are the subject matter of the respective dependent claims and are explained in the following description of the invention.

The above and other objects, which will be apparent to those skilled in the art, are achieved in the present invention which is directed to a plug-in connector comprising an inner conductor and an insulator surrounding the inner conductor, wherein the insulator has a first insulator part and a second insulator part which are interconnected such that they can rotate with respect to each other at an insulator joint having two structurally separate parts which slide against each other during the relative movement, such that the insulator parts are biased in a relative neutral position by a spring device.

The insulator joint makes possible a relative rotation around a longitudinal axis of one of the two insulator parts as well as around an axis perpendicular to the longitudinal axes of both insulator parts. One of the insulator parts may include a partially spherical outer surface which lies against a partially spherical inner surface of a housing. One of the insulator parts may include a groove within which a section of the other insulator part which is round in cross section is arranged.

The groove is arranged in the section of the insulator part forming the partially spherical outer surface.

The spring device may be comprised of a flat surface or an edge on the partially spherical outer surface defining a flat surface which, in the neutral position, lies flat against a flat contact surface of an elastically deflectable spring element.

A first inner conductor part and a second inner conductor part of the inner conductor are connected pivotably by an inner conductor joint. One of the inner conductor parts forms a fork which accommodates a section of the other inner conductor section which is round in cross section.

An outer conductor surrounds the inner conductor and the insulator. The plug-in connector may further include a housing which forms a part of the outer conductor.

In a second aspect, the present invention is directed to a multiple plug-in connector with several plug-in connectors, including and a housing integrating the plug-in connectors. The multiple plug-in may include several plug-in connectors wherein the housing forms a part of the outer conductors of all plug-in connectors.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
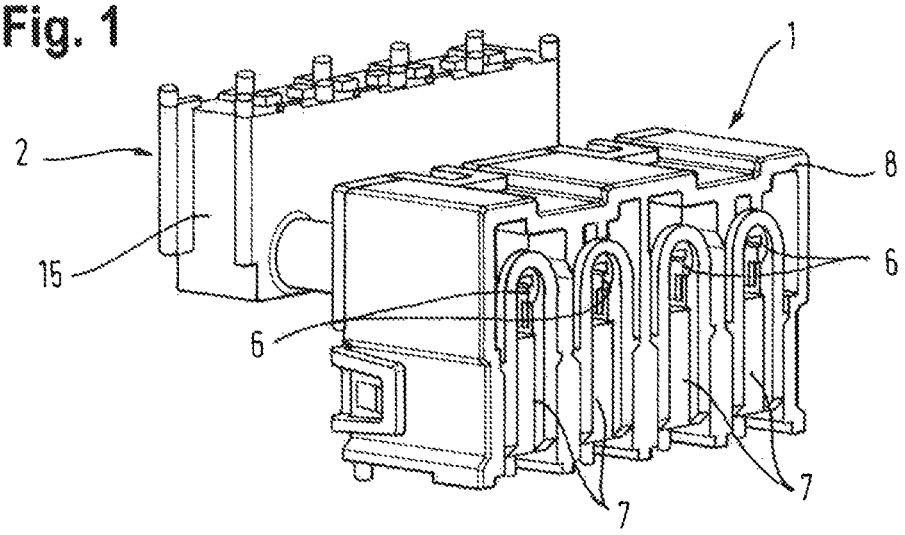
FIG. 1 shows a perspective view of a plugged connection with a multiple plug-in connector according to the invention as well as a mating plug-in connector in the unplugged state.
Figure 2:
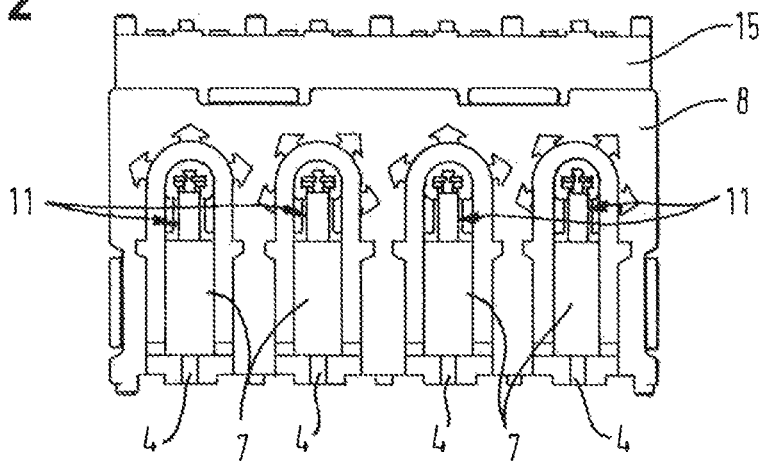
FIG. 2 shows a front view of the plugged connection.
Figure 3:
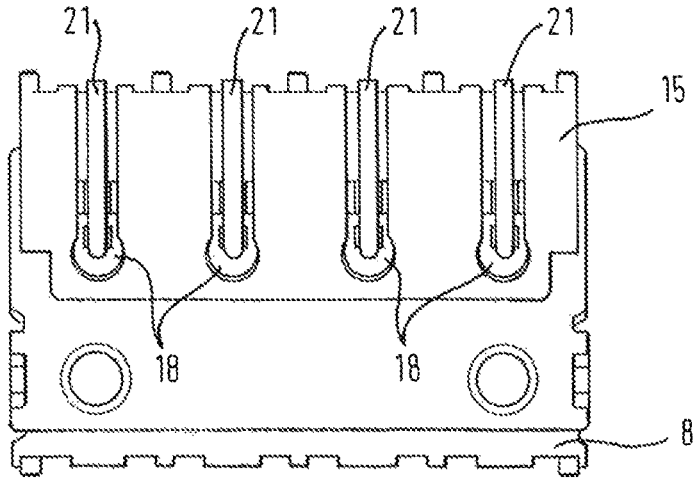
FIG. 3 shows a rear view of the plugged connection.
Figure 4:
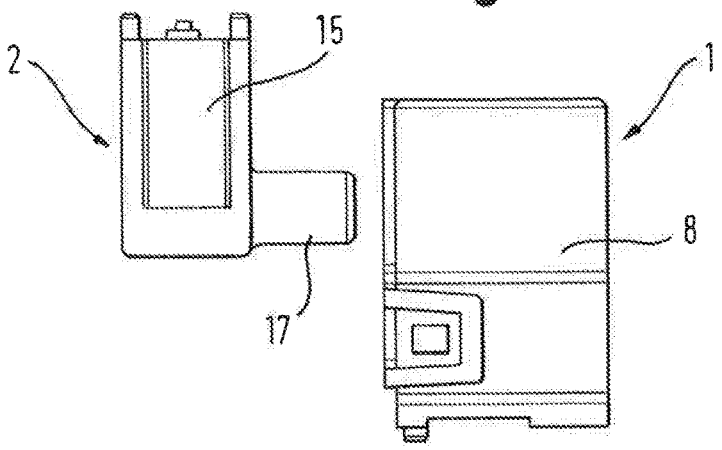
FIG. 4 shows a side view of the plugged connection.

In describing the preferred embodiment of the present invention, reference will be made herein to FIGS. 1-10 of the drawings in which like numerals refer to like features of the invention.

According to the invention, a plug-in connector according to the invention with an (elongated, in particular tubular or pin-formed) inner conductor and an insulator surrounding the inner conductor is characterized in that the insulator has a first insulator part and a second insulator part structurally separate from the first insulator part which are connected so as to rotate relative to one another by means of an insulator joint.

"Joint" is understood to mean that two structurally separate parts (i.e., not formed in a single piece) interact in such a way that they form at least one axis of rotation for their relative rotation, whereby the two parts are in direct or indirect contact and in particular slide against one another during their relative rotation.

The plug-in connector according to the invention can be designed as a right-angled plug-in connector, whereby the inner conductor has a first inner conductor part and a second inner conductor part, the longitudinal axes of which are aligned at an angle to one another.

The design of a plug-in connector according to the invention makes it possible to integrate the inner conductor substantially immovably in the insulator, which is preferably formed of a rigid material, as a result of which the inner conductor is well protected. In particular, this can prevent the inner conductor, which is often in the form of a delicate metal part, from being bent as the plug-in connector is being handled, and in particular when plugging it together with a mating plug-in connector. The integration of a joint in the insulator ensures the desired functionality of tolerance equalization, so that the plug-side end of the inner conductor (together with the corresponding sections of the insulator) can move within certain limits.

In a preferred embodiment of the plug-in connector according to the invention, in particular in the preferred embodiment as an right-angled plug-in connector, it can be the case that the insulator joint makes possible a relative rotation at least around the longitudinal axis of one of the two insulator parts (preferably not of the plug-side insulator part) as well as around an axis perpendicular to two longitudinal axes of the insulator parts. It can also preferably be the case that a relative rotation around the longitudinal axis of the other insulator part and in particular a rotation of the plug-side insulator part around its own longitudinal axis is not possible due to a corresponding design of the insulator joint.

In an advantageous possible design of the insulator joint, one of the insulator parts can have a partially spherical outer surface which is arranged in a partially spherical inner surface of a housing of the plug-in connector. This allows the relative rotation of the insulator parts to be guided reliably irrespective of the direction of rotation.

It can also preferably be the case that one of the insulator parts contains a groove in which a section of the other insulator part which is round in cross section, in particular cylindrical, is arranged. This makes possible, by simple means, a relative rotation of the insulator parts around the longitudinal axis of the sections with a round cross section as well as around an axis running transversely to the groove. At the same time, an undesired relative rotation around a third axis, perpendicular to these two axes, for example the longitudinal axis of the plug-side insulator part, can be effectively prevented. It can thereby particularly preferably be the case that the groove is arranged in the section of the insulator part forming the partially spherical outer surface and also preferably extends in the direction of the longitudinal axis of this insulator part.

In a preferred embodiment of the plug-in connector according to the invention, it can also be the case that the insulator parts are biased, by means of a spring device, into a neutral position relative to one another which these assume automatically in an unloaded state. By these means it can be ensured that the plug-side insulator part as well as the inner conductor part arranged therein are in a defined orientation on being plugged together with a mating plug-in connector.

Such a spring device can for example comprise a flat surface or an edge defining a flat surface on the partially spherical outer surface of one outer conductor part which, in the neutral position, lies flat against a flat contact surface of an elastically deflectable spring element. In this case a rotation of this outer conductor part can cause a tilting of the flat surface (defined by the edge) relative to the contact surface, as a result of which this, or the spring element, is elastically deflected.

In particular if the inner conductor parts are arranged substantially immovably within the insulator parts, the relative rotation of the insulator parts can also lead to a relative rotation of the inner conductor parts. In the case of an inner conductor formed in a single piece this can be made possible through a deformation, in particular in an angled section of the inner conductor. However, it can be advantageous for a joint also to be integrated in the inner conductor, so that a first inner conductor part and a second inner conductor part, structurally separate from the first inner conductor part, are connected, so as to rotate relative to one another, by means of an inner conductor joint. It can thereby particularly preferably be the case that the inner conductor joint makes possible a relative rotation around at least the same axes as the insulator joint.

In a structurally simple design of such an inner conductor joint, one of the inner conductor parts can form a fork which accommodates a round cross-sectioned, in particular cylindrical section of the other inner conductor section.

In order to achieve a good transmission performance for radio frequency signals, an outer conductor surrounding the inner conductor and the insulator can be provided which acts as shielding for the inner conductor. It can thereby be the case that a housing of the plug-in connector forms the outer conductor or a part thereof.

A multiple plug-in connector according to the invention comprises at least several plug-in connectors according to the invention as well as a housing integrating the plug-in connectors. It can thereby be the case that the housing forms a part of outer conductors of all plug-in connectors, as a result of which a structurally simple design for the multiple plug-in connector can be achieved.

FIGS. 1 to 8 show a plugged connection with two plug-in connectors, a multiple plug-in connector 1 according to the invention and a matching mating plug-in connector 2. The plugged connection serves to connect, in an electrically conductive manner, two (sections of) circuit boards (not shown) which are substantially oriented parallel to one another, for the transmission of radio frequency signals. For this purpose, both plug-in connectors are designed as (multiple) right-angled plug-in connectors. Accordingly, the plugging direction in which the plug-in connectors can be plugged together runs substantially parallel to the supporting surface of the circuit boards against which the plug-in connectors are intended to lie.

Each of the plug-in connectors comprises a plurality of inner conductors which are each surrounded, at least in sections, by an insulator and an outer conductor. This provides a coaxial conductor arrangement with a good shielding effect for the signal-carrying inner conductor.

The inner conductors of the multiple plug-in connector 1 according to the invention, which serves as a coupler, are designed in two parts and comprise a tubular-formed first inner conductor part 3 arranged on the plug side and a pin-formed second inner conductor part 4 arranged on the circuit board side. Both inner conductor parts 3, 4 have longitudinal axes which intersect at an angle of approximately 90°. An inner conductor joint is formed in the contact region of the two inner conductor parts 3, 4 which makes it possible for the inner conductor parts 3, 4 to rotate relative to one another. For this purpose, the end of the first inner conductor part 3 facing the second inner conductor part 4 is fork-shaped. An elongated slot is formed between two lugs 5, said slot widening on both sides at one point. A cylindrical section of the second inner conductor part 4 is held at this point, with a slight spreading of the slot and thus an elastic deflection of the two lugs 5. This design of the inner conductor joint makes possible a largely reaction-force-free swiveling of the first inner conductor part 3 around the longitudinal axis of the second inner conductor part 4 as well as around an axis perpendicular to the longitudinal axes of both inner conductor parts 3, 4.

The inner conductors are in each case held, largely immovably, in receiving openings of an insulator. The insulators of the multiple plug-in connector 1 are also designed in two parts. These comprise a first insulator part 6 which in each case accommodates the whole of the first inner conductor part 3 and the section of the second inner conductor part 4 forming the inner conductor joint. The insulators of the multiple plug-in connector 1 also each comprise a second insulator part 7, through which the second inner conductor part 4 extends. The longitudinal axes of the insulator parts 6, 7 are oriented coaxially or parallel to the longitudinal axes of the inner conductor parts 3, 4 and thus also extend approximately at right angles to one another. The insulators form an insulator joint between the two respective insulator parts 6, 7, which makes possible a swiveling of the insulator parts 6, 7 relative to one another. Like the inner conductor joints, the insulator joints make possible a relative rotation (or a swiveling of the first insulator parts 6) around the longitudinal axis of the second insulator parts 7 as well as around an axis perpendicular to the longitudinal axes of both insulator parts 6, 7. In contrast, a relative rotation around the longitudinal axis of the first insulator part 6 is substantially not possible.

In order to form the insulator joints, each of the first insulator parts 6 has on its rear end (i.e. not the plug-side end) a partially spherical outer surface, a section of which lies against a partially spherical inner surface of a housing 8 of the multiple plug-in connector 1. In addition, the rear ends of the first insulator parts 6 form longitudinal grooves 9 on the sides adjacent to the second insulator parts 7 (running in the direction of the longitudinal axes of the first insulator parts 6), into which partially cylindrical swivel pins 11 of the second insulator parts 7 project. The swivel pins 11, the basic form of which is cylindrical, form ribs 12 extending in the direction of the longitudinal axes of the first insulator parts 6 which serve as limit stops for a swiveling of the first insulator parts 6 around the longitudinal axes of the second insulator parts 7.

Figure 5:
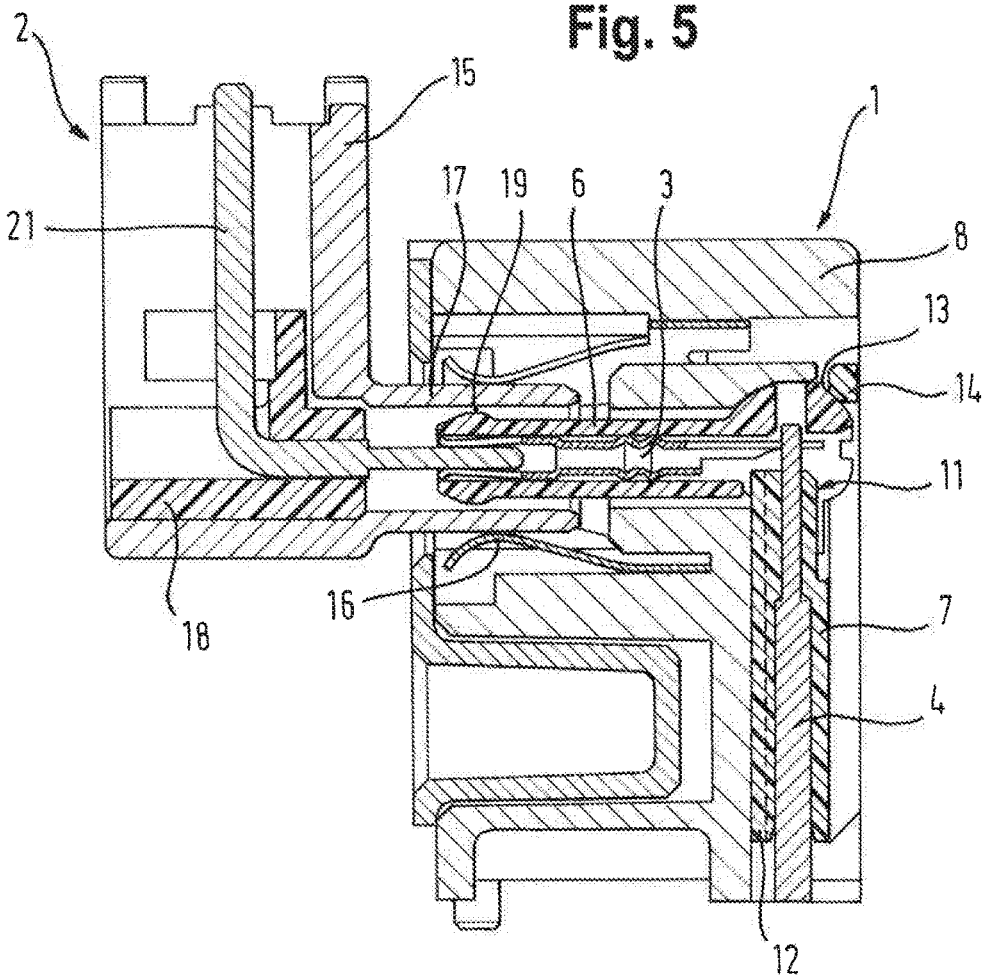
FIG. 5 shows a longitudinal section through the plugged connection in the partially plugged state with the plug-in connectors in neutral position.

The insulators each form a spring device through which the two insulator parts 6, 7 are biased in the neutral position shown in FIG. 5. The spring devices each have a partially peripheral projection 13 forming an edge on the spherical shaped end of the first insulator part 6 as well as an elastically deflectable, bow-shaped section 14 of the second insulator part 7. In the neutral position, the peripheral projection 13 of the first insulator part 6 lies, substantially over its entire length, against a flat contact surface of the deflectable section 14.

Figure 6:
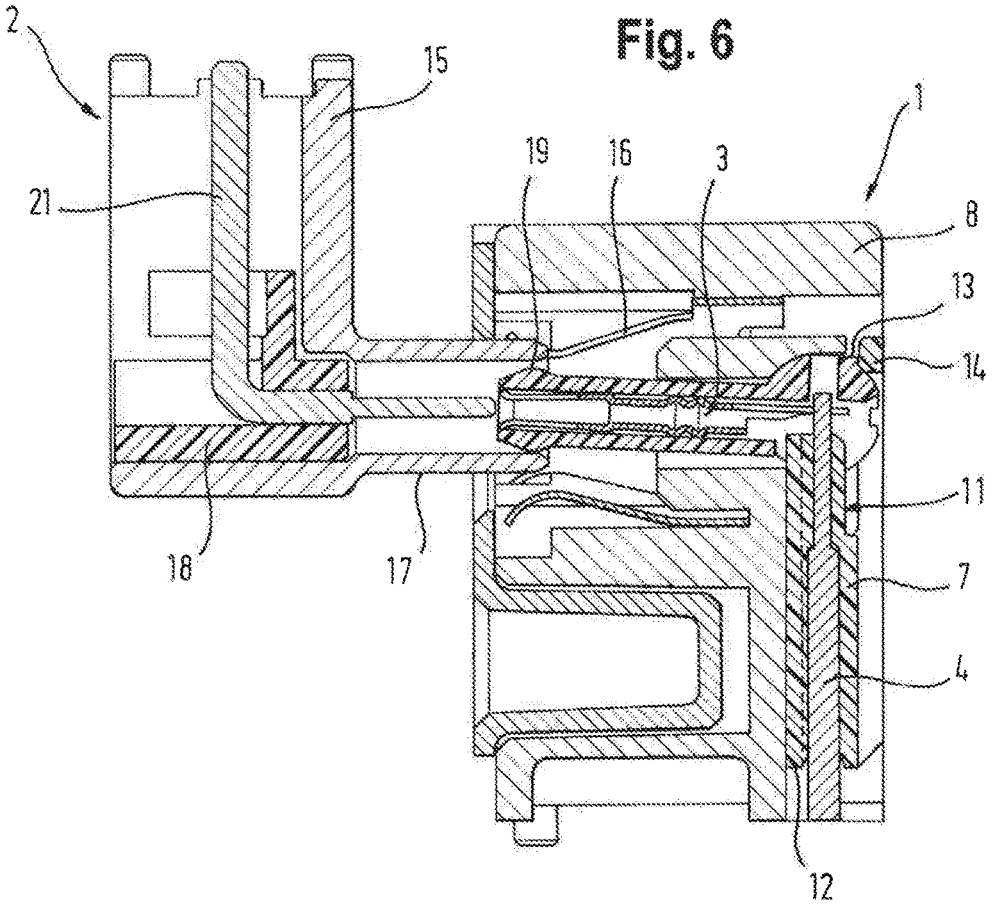
FIG. 6 shows a longitudinal section through the plugged connection in the partially plugged state with the plug-in connectors in offset position.
Figure 7:
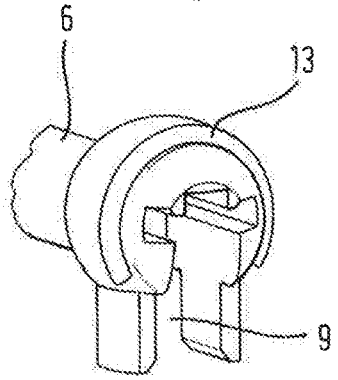
FIG. 7 shows a perspective view of a first insulator part of the multiple plug-in connector.
Figure 8:
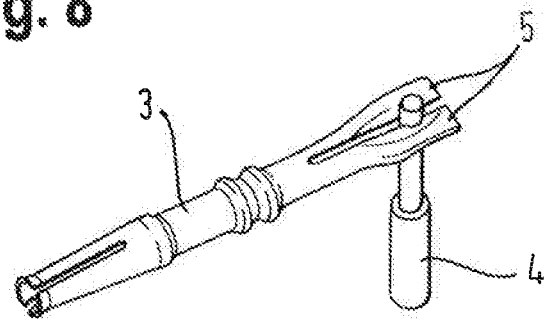
FIG. 8 shows a perspective view of an inner conductor of the multiple plug-in connector.

If, other than as shown in FIG. 5, the two plug-in connectors are not plugged together substantially exactly coaxially in relation to the longitudinal axes of the plug-side parts of the inner conductors or the insulators, a contact between outer conductors of the mating plug-in connectors 2 with the plug-side ends of the first insulator parts 6, which each have a conical peripheral projection 19, leads to a lateral deflection or a swiveling of the first insulator parts 6, as shown in FIG. 6 by way of example for a swiveling around the axis arranged perpendicular to the longitudinal axes of both insulator parts 6, 7. The planes defined by the peripheral projections 13 on the spherical ends of the first insulator parts 6 thereby tilt in relation to the contact surfaces of the deflectable sections 14 of the second insulator parts 7.

Due to the partially spherical ends of the first insulator parts 6 resting in the partially spherical inner surfaces of the housing 8, the centers of rotation for the swiveling of the first insulator parts 6 lie roughly in the centers of the partially spherical ends. As a result, due to the contact with the peripheral projections 13, the deflectable sections 14 of the second insulator parts 7 are elastically deflected. The pretension in the deflectable sections 14 created in this way causes an elastic biasing of the insulator parts 6, 7 in their neutral positions.

Figure 9:
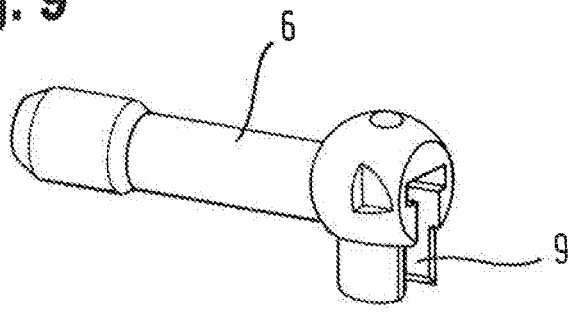
FIG. 9 shows a perspective view of an alternative first insulator part for a multiple plug-in connector according to the invention.
Figure 10:
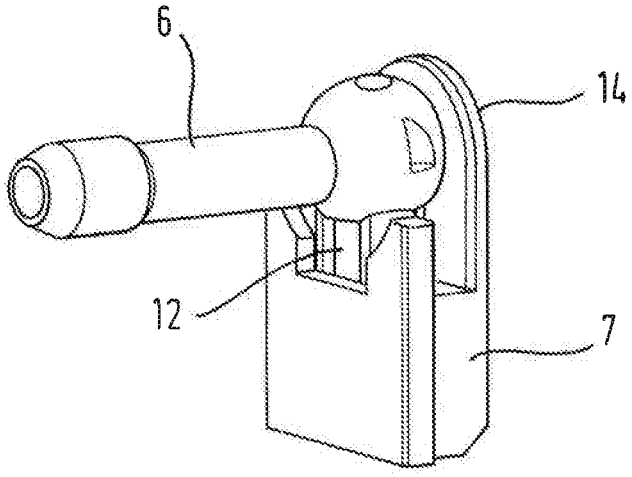
FIG. 10 shows a perspective view of the insulator part according to FIG. 9 with associated second insulator part.

FIGS. 9 and 10 show an alternative design of a two-part insulator which can be used in a multiple plug-in connector according to the invention as shown in FIGS. 1 to 8 in place of the insulators used therein. In this insulator, the elastic biasing of the insulator parts 6, 7 in a neutral position is achieved in that a flat end surface of the first insulator part 6 lies against a (closed) flat contact surface of an elastically deflectable section 14 of the second insulator part 7. As in the insulators shown in FIGS. 1 to 8, a swiveling of the first insulator part 6 out of the neutral position causes an elastic deflection of the deflectable section 14 of the second insulator part 7.

Both plug-in connectors have outer conductors which, at least in sections, surround the associated inner conductors coaxially. Also, in both plug-in connectors, the housings 8, 15, formed of electrically conductive material, represent at least a part of the respective outer conductor. In the multiple plug-in connector 1, a ring-formed spring tab cage 16 made of elastic, electrically conductive material which is connected with the housing 8 is provided for each inner conductor. A tubular-formed outer conductor section 17 of the mating plug-in connector 2 forming an integral part of the housing 15 is plugged into each of the spring tab cages 16. The spring tab cages 16 are thereby spread radially so that these lie, under pressure, against the outer sides of the outer conductor sections 17. This ensures a good contact between the outer conductors of both plug-in connectors, even when the plug-in connectors are not plugged together in an exactly coaxial alignment, in this way realising a tolerance-equalising functionality for the outer conductors.

The single-piece inner conductors 21 of the mating plug-in connector 2 are pin-formed in design and angled by around 90°. The position of each of the inner conductors 21 within the housing 15 is secured by means of an insulator 18 made of a dielectric material, which also insulates it electrically from the housing 15 serving as outer conductor.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug-in connector comprising an inner conductor and an insulator surrounding the inner conductor, wherein the insulator has a first insulator part surrounding the inner conductor and a second insulator part surrounding the inner conductor which are interconnected such that they can rotate with respect to each other at an insulator joint having two structurally separate parts which slide against each other during the relative movement, wherein the insulator comprises a spring device, wherein the spring device comprises a flat surface of the first insulator part and an elastically deflectable section of the second insulator part having a flat contact surface, and wherein in a neutral position the flat surface of the first insulator part lies against the flat contact surface of the elastically deflectable section of the second insulator part.

2. The plug-in connector of claim 1, wherein the insulator joint makes possible a relative rotation around a longitudinal axis of one of the two insulator parts as well as around an axis perpendicular to the longitudinal axes of both insulator parts.

3. The plug-in connector of claim 2, wherein one of the insulator parts includes a partially spherical outer surface which lies against a partially spherical inner surface of a housing.

4. The plug-in connector of claim 1, wherein one of the insulator parts includes a partially spherical outer surface which lies against a partially spherical inner surface of a housing.

5. The plug-in connector of claim 4 wherein the spring device comprises the flat surface or an edge on the partially spherical outer surface defining the flat surface which, in the neutral position, lies flat against the flat contact surface of the elastically deflectable section.

6. The plug-in connector of claim 5, wherein a first inner conductor part and a second inner conductor part of the inner conductor are connected pivotably by an inner conductor joint.

7. The plug-in connector of claim 4, wherein one of the insulator parts includes a groove within which a section of the other insulator part which is round in cross section is arranged.

8. The plug-in connector of claim 1, wherein one of the insulator parts includes a groove within which a section of the other insulator part which is round in cross section is arranged.

9. The plug-in connector of claim 8, wherein the groove is arranged in the section of the insulator part forming the partially spherical outer surface.

10. The plug-in connector of claim 9 wherein the spring device comprises the flat surface or an edge on the partially spherical outer surface defining the flat surface which, in the neutral position, lies flat against the flat contact surface of the elastically deflectable section.

11. The plug-in connector of claim 1, wherein a first inner conductor part and a second inner conductor part of the inner conductor are connected pivotably by an inner conductor joint.

12. The plug-in connector of claim 11, wherein one of the inner conductor parts forms a fork which accommodates a section of the other inner conductor section which is round in cross section.

13. The plug-in connector of claim 11 wherein an outer conductor surrounds the inner conductor and the insulator.

14. The plug-in connector of claim 1, wherein an outer conductor surrounds the inner conductor and the insulator.

15. The plug-in connector of claim 14, including a housing which forms a part of the outer conductor.

16. A multiple plug-in connector with several plug-in connectors comprising an inner conductor and an insulator surrounding the inner conductor, wherein the insulator has a first insulator part surrounding the inner conductor and a second insulator part surrounding the inner conductor which are interconnected such that they can rotate with respect to each other at an insulator joint having two structurally separate parts which slide against each other during the relative movement, wherein the insulator comprises a spring device, wherein the spring device comprises a flat surface of the first insulator part and an elastically deflectable section of the second insulator part having a flat contact surface, and wherein in a neutral position the flat surface of the first insulator part lies against the flat contact surface of the elastically deflectable section of the second insulator part; and a housing integrating the plug-in connectors.

17. The multiple plug-in connector of claim 16 including said several plug-in connectors wherein the housing forms a part of the outer conductors of all plug-in connectors.

* * * * *